United States Patent [19]

Redman

[11] 3,990,587

[45] Nov. 9, 1976

[54] COIL TRANSFER APPARATUS

[75] Inventor: Howard E. Redman, Duxbury, Mass.

[73] Assignee: Mathewson Corporation, Quincy, Mass.

[22] Filed: Dec. 11, 1975

[21] Appl. No.: 639,613

[52] U.S. Cl. ..... 214/8.5 C; 198/396; 198/379; 198/394; 214/1 BB; 214/1 BC; 214/1 Q; 214/147 T; 221/225

[51] Int. Cl.[2] ..... B66C 1/42

[58] Field of Search ..... 214/8.5 A, 8.5 C, 91 R, 214/1 BB, 1 BC, 1 BD, 147 G, 151, 1 Q, 147 T; 198/237, 238, 241, 243, 257, 278; 221/225, 236

[56] References Cited

UNITED STATES PATENTS 3,193,136 7/1965 Stumpf ..... 221/40

FOREIGN PATENTS OR APPLICATIONS 1,326,690 8/1973 United Kingdom ..... 198/241

*Primary Examiner*—Robert G. Sheridan
*Assistant Examiner*—George F. Abraham
*Attorney, Agent, or Firm*—Robert T. Gammons

[57] ABSTRACT

Apparatus for separating coils from groups of coils and orienting them for presentation in-line correspondingly oriented about their longitudinal axes to a coil assembly machine, comprising in parallel relation a plurality of conveyors corresponding in number to the number of in-line coils to be presented to the assembly machine, for moving batches of interengaged coils along a predetermined path and for partially separating the coils as they travel therealong, and a gripper assembly associated with each conveyor arranged to successively grasp and complete separation of the leading coil of the group of coils while the remaining coils of the group are withheld, position it on a turntable for rotation about its vertical axis so that its knot is in a predetermined position of orientation, invert the separated coil after it has been rotated about its vertical axis and by such inversion present it to an assembly machine.

43 Claims, 17 Drawing Figures

COIL TRANSFER APPARATUS

BACKGROUND OF THE INVENTION

Coil transfer apparatus are shown in the Fischer and Stumpf U.S. Pat. Nos. 3,575,303 and 3,193,136. In the Fischer apparatus the nest of coils are separated by reciprocating pins which enter the ends of the coil so as to push the leading coil forwardly to a gripper and to restrain the succeeding coil. In the Stumpf apparatus there is a lifter for lifting the lower end of the leading coil of the batch above the succeeding coils and a gripper for pulling the coils forwardly from the succeeding coils. In a tightly packed group the turns of adjacent coils are so closely spaced that such mechanisms as described are not entirely effective so that more than one coil may be pulled forwardly at a time, moreover, the mechanisms are complex, difficult to time, adjust and expensive to manufacture. It is the purpose of this invention to accomplish the same purpose with a greatly simplified apparatus by means of which the coils are separated from the groups in stages and leading coil operates to block the succeeding coil from being grasped. Further objects are to provide an apparatus which embodies the least amount of manipulation of the coils as they travel through the machine so as to keep the complexity of the machine to a minimum and to enable simple control by means of air operated cylinders supplied with pressure by way of manually and electrically operated air flow swtiches.

SUMMARY OF INVENTION

Coil transfer apparatus for delivering coil springs in predetermined positions of orientation to a spring assembly machine wherein there are a plurality of parallely arranged transfer devices for delivering a transverse line of coils to a coil assembly machine and wherein each transfer device comprises a conveyor for receiving a batch of coils standing on end and moving the batch along a predetermined path, means situated along the path of the conveyor operable in conjunction therewith to effect partial separation of the coils as they travel therealong, a gripper at the delivery end of the conveyor for taking hold of the leading coil of the partially separated coils exclusively of the remaining coils in the group and completing its separation from the remaining coils, a turntable upon which the separated coil is adapted to be placed standing upright for rotation about its vertical axis and a carriage supporting the gripper for movement onto the turntable for such rotation, said gripper being rotatable on the carriage following rotation of the coil about its vertical axis to invert the coil end for end and said gripper being thereafter operable to release the coil in its inverted position. The means for effecting partial separation comprise friction engendering members situated at opposite sides of the conveyor which retard forward movement of the coils as they are moved forwardly by the conveyor, specifically lugs on the conveyor move the coils forwardly and the friction engendering means comprise tracks at opposite sides of the conveyor at the upper and lower ends of the coils respectively, the opposed edges of which converge in the directon of movement of the conveyor. The converging edges not only retard the coils so as to string them out but also effects rotation of the coils to dispose their knots all in the same direction. There is first sensing means at the delivery end of the conveyor responsive to the presence of the leading coil at the delivery end to stop the conveyor and second sensing means operable when there is a gripper in a position adjacent the delivery end of the conveyor to receive the coil to cause the gripper to grip the coil and simultaneously effect movement of the carriage from said position adjacent the delivery end of the conveyor to a position adjacent the turntable. There is means operable by the movement of the carriage to said latter position to rotate the turntable to turn the coil about its vertical axis and means operable by rotation of the turntable a predetermined amount to initiate rotation of the gripper on the carriage to move it from a position adjacent the turntable to a predetermined position adjacent the assembly machine inverted and release the grip of the gripper on the coil. The first sensing means is operative in the absence of a coil at the delivery end of the conveyor in readiness to be gripped to start the conveyor. There is means arranged in the path of movement of the batch of coils as they travel toward the delivery end of the conveyor at a level above the lowermost loop of the leading coil operable to yieldably resist displacement of the succeeding coil from the batch of coils during the final separation of the leading coil therefrom. The turntable is elevated with respect to the plane of the conveyor and there is means for raising the lower end of the coil onto the platform so that the coil is compressively held engaged with the turntable during rotation and means on the turntable engageable with the lower end loop for imparting the rotation of the turntable to the coil. The guide rails at opposite sides of the conveyor effect rotation of the coils to dispose the knots substantially centrally with respect to the path of movement of the coils and the means on the turntable for effecting rotation of the coils is displaced laterally with respect to the path of movement of the knots away from the direction of rotation of the turntable so that rotation of the turntable brings the aforesaid means into engagement with the knots. The gripper comprises a slotted plate rotatable about a horizontal axis transverse to the path of movement of the conveyor which is lowered into engagement with a convolution intermediate the ends of the coil to draw the coil forwardly while permitting the coil to be rotated about its vertical axis within the grip of the slotted plate. A motor is provided for driving the conveyor, air cylinders are provided for engaging and disengaging the starting clutch, lowering and raising the slotted plate into and out of engagement with the coil, reciprocating the carriage, rotating the turntable and rotating the gripper assembly and a control circuit including sensing means which control the cycling of the apparatus.

The invention will now be described in detail with reference to the accompanying drawings, wherein.

The separating, orienting and transfer appratus 10 of this invention is designed to receive batches of interengaged coils, separate the coils, rotate them about their longitudinal axes to dispose the knots in a predetermined position of orientation and present a line of such separated oriented coils to a spring assembly machine for lacing of the coils in the formation of an inner spring mattress assembly or the like.

Figure 1:
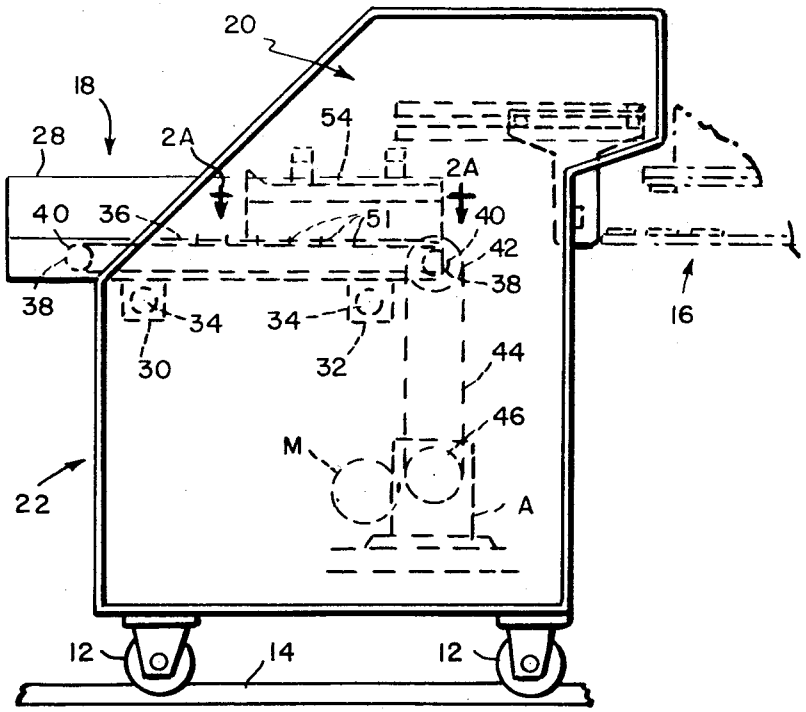
FIG. 1 is a side elevation of the coil separating and transferring apparatus of this invention.
Figure 2:
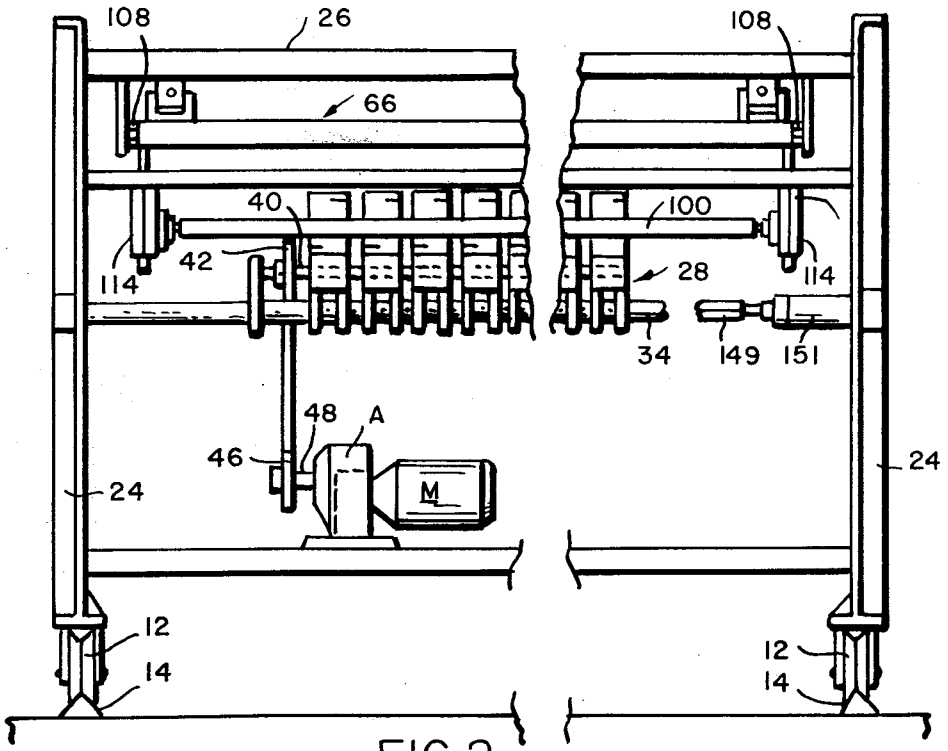
FIG. 2 is a front elevation as seen from the right side of FIG. 1.
Figure 2A:
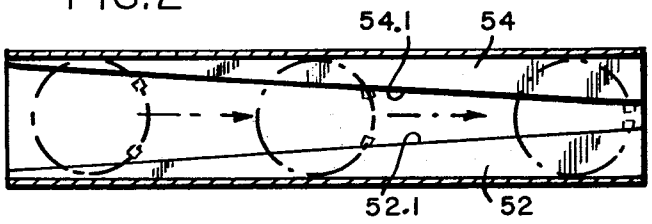
FIG. 2A is a section taken on the line 2A—2A of FIG. 2.

The apparatus, FIGS. 1 and 2, comprises a plurality of sub-assemblies arranged side-by-side on a supporting frame each sub-assembly comprising conveyor means 18 for receiving batches of coils and a combination separating, orienting and transfer means 20 for separating individual coils from the batch, orienting them so that the knots are all positioned in a predetermined position of orientation, inverting them and presenting them to a coil spring assembly machine 16. The conveyor means 18 and combined separating, orienting and transfer means 20 of which there are as many as there are coils lengthwise of the assembly of coils to be made are mounted on a frame 22, supported by wheels 12 on tracks 14 so that the apparatus may be moved to a position adjacent the coil assembly machine 16, a fragmentary portion of which is shown diagrammatically in FIGS. 1, 3, 4 and 12 and comprises spaced parallel vertically disposed frame members 24—24 rigidly connected by spaced parallel horizontally disposed beams 26.

Since each sub-assembly comprising the conveyor means 18 and the combination separating, orienting and transfer means 20 are identical transversely of the apparatus the description will be confined for the most part to a single sub-assembly and in its relation to the supporting frame.

Figure 4:
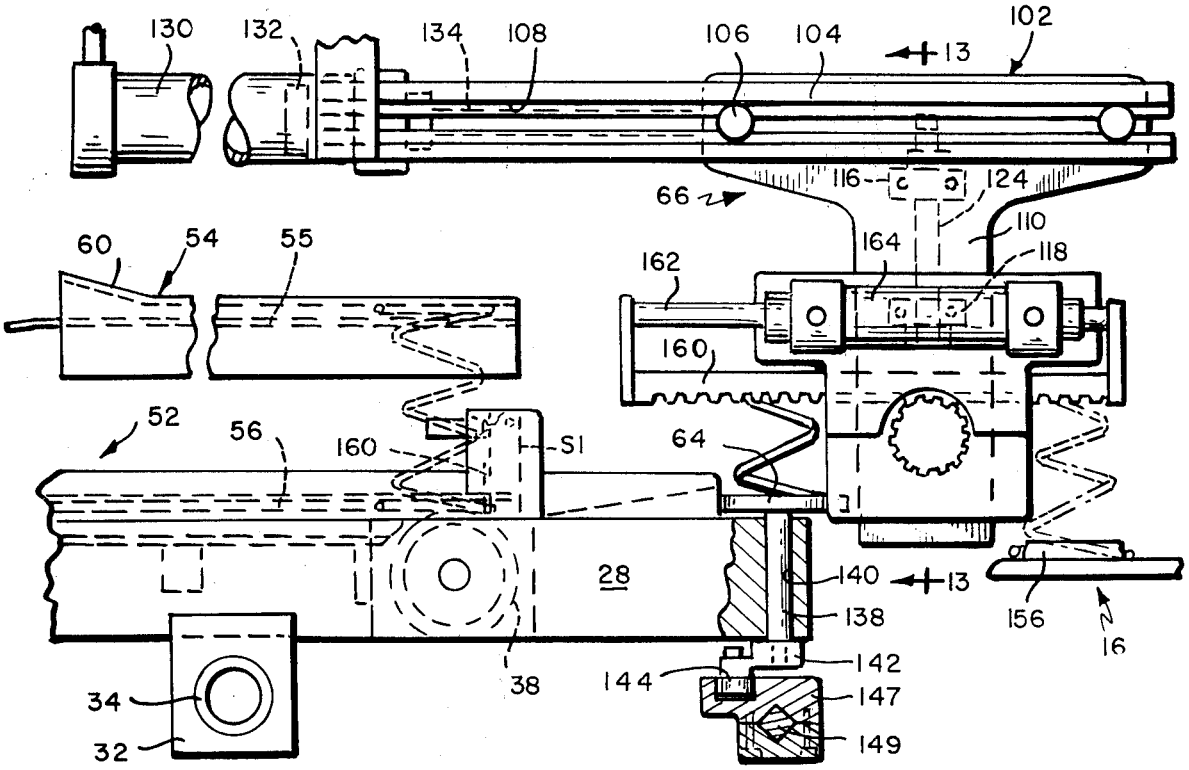
FIG. 4 is a side elevation of the coil orienting and transfer means in the transfer position.
Figure 3:
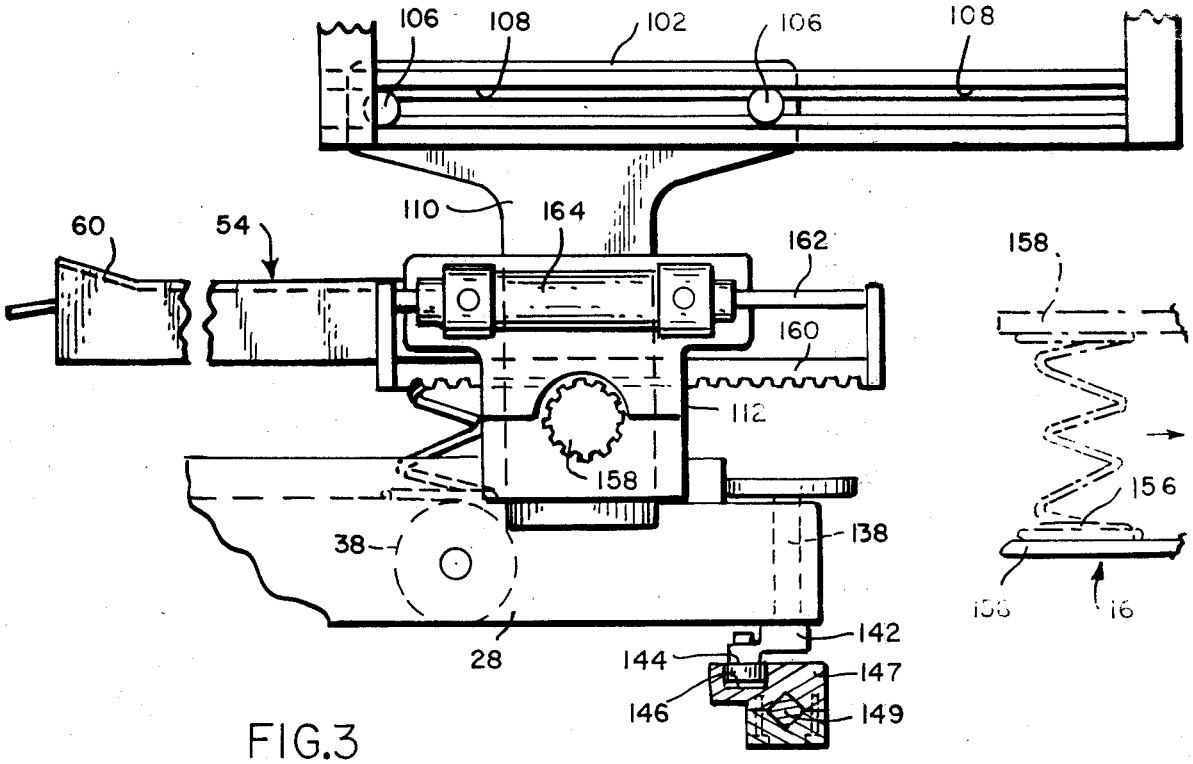
FIG. 3 is a fragmentary side elevation to much larger scale showing the position of the coil orienting and transfer means in the position for receiving a coil.
Figure 5:
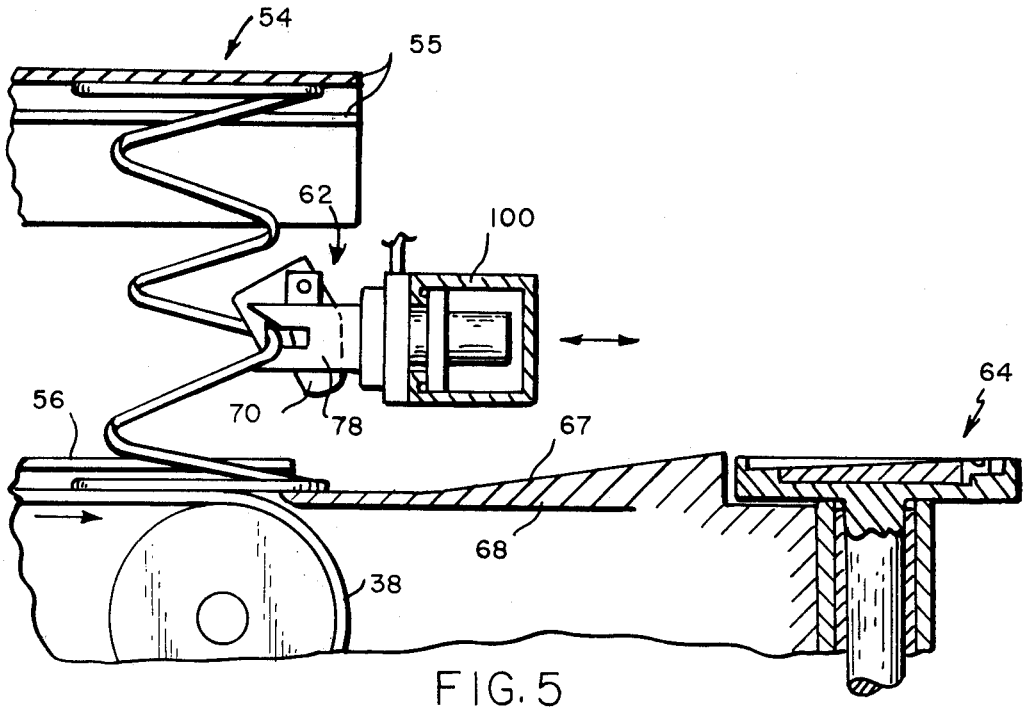
FIG. 5 is a fragmentary elevation to still larger scale showing the gripper assembly engaged with a coil for moving the coil onto the turntable.
Figure 6:
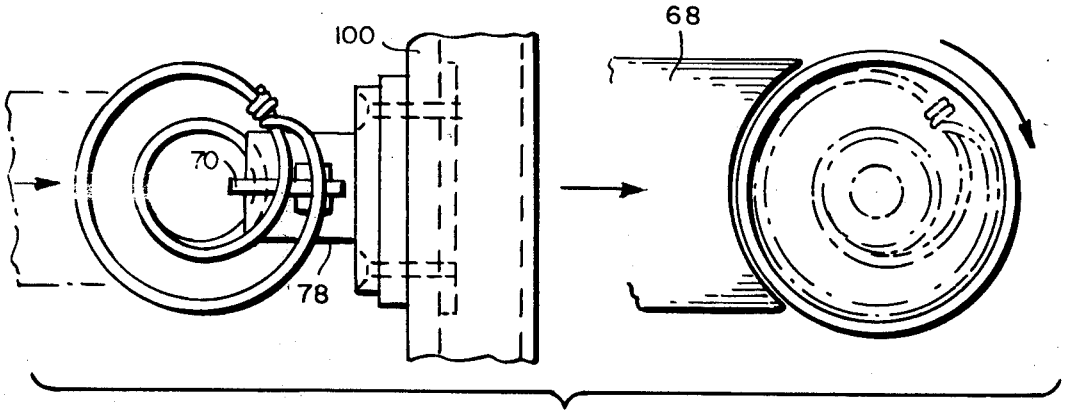
FIG. 6 is a plan view of FIG. 5.
Figure 7:
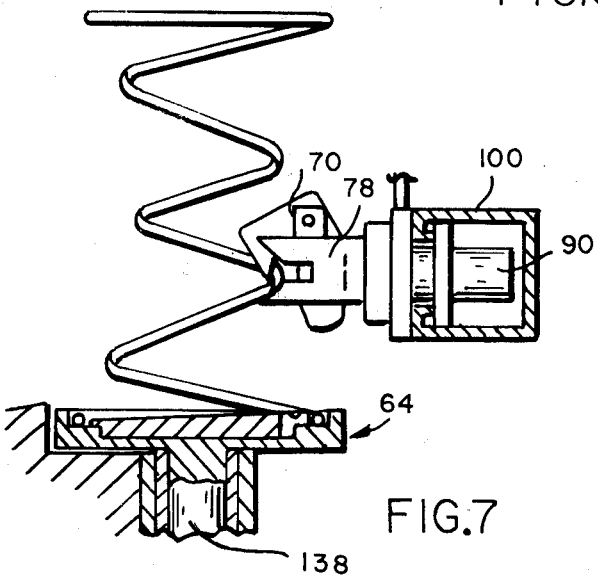
FIG. 7 is a fragmentary elevation showing the coil drawn onto the turntable.
Figure 8:
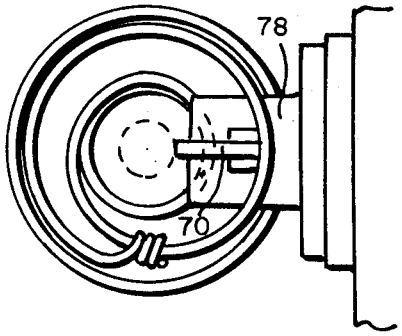
FIG. 8 is a plan view of FIG. 7.

Referring to FIGS. 1, 2 and 4, each conveyor means 18 is supported on the frame 22 by means of an elongate horizontal beam 28. Bearing blocks 30, 32 at the rear and forward ends of the beams 28 support the beams side-by-side on horizontally disposed shafts 34—34 supported transversely of the frame with their ends fixed in the frame members 24—24. As thus supported the number of sub-frames may be increased or decreased as required and the spacing between them may be correspondingly increased or decreased to provide for the number and spacing of the springs according to the spring assembly to be made. The sub-frames 28 when mounted are fixed at a spacing corresponding to the spacing of the coil receiving dies of the spring assembly machine to which the coils are to be presented.

Each conveyor means comprises endless chains 36—36 entrained about sprockets 38—38 mounted on spaced parallel shafts 40—40 journaled in the several sub-frames 28, the shafts 40—40 being common to the entire number of sub-frames. The forward one of the shafts 40 has on it a sprocket 42 by means of which it is rotated to drive the several conveyors. A chain 44 entrained about the sprocket 42 and about a sprocket 46 mounted on a shaft 48 driven by a motor M by way of a clutch A provides for rotating the forward one of the shafts 40 and hence driving the conveyor.

The endless chains 36—36 of the conveyor have on their links upwardly projecting lugs 51—51 which by engagement with the groups of coils placed on the upper runs of the chains will advance the groups of coils along the upper runs toward the combination separating, orienting and transfer means 20.

As the group of coils is moved along the conveyor chains they are confined at their lower and upper ends, by a guide 52 at their lower ends and a guide 54 at their upper ends. The guide 52 is constituted by a flat plate 56 spaced from and parallel to the conveyor beneath which the lower end loop of the coil is engage. The guide 54 is constituted by spaced parallel plates 55—55 parallel to the conveyor with which the upper end loop is engaged. The guides 52 and 54 are situated at opposite sides of the conveyor and their opposed edges 52.1 and 54.1 converge in the direction of movement and by engagement with the knots at the end of the coils turn the coils about their vertical axes so as to dispose the knots all in the same direction at the forward side and substantially centered in the direction of movement. To facilitate entrance of the end loops at the tops into the upper guide 54 the upper plate 55 is provided with a flared entrance wall 60 which slopes downwardly in the direction of movement of the coils into the guide. The guides 52, 54 in addition to effecting rotation of the coils effect an initial partial separation of the coils in the group of coils so that when the leading coil of a group reaches the delivery end of the conveyor it will close the gripper to the extent that it will accept no more than one turn of wire of a given gauge and at the same time enter the space between the leading coil and the succeeding coil. The guides resist forward movement of the coils in opposition to the forward movement imparted thereto by the lugs on the conveyor thus stringing the coils out relative to each other.

Figure 9:
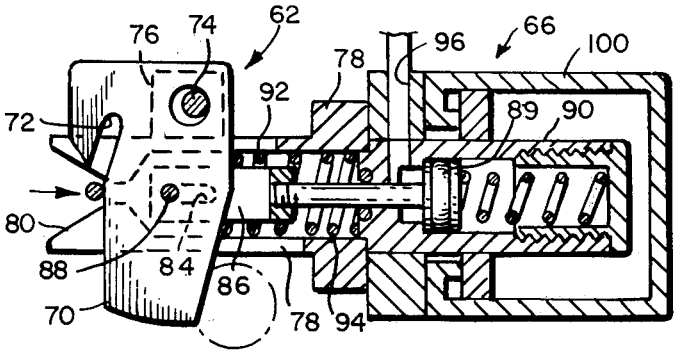
FIG. 9 is a fragmentary elevation partly in section showing the initial position of the gripper assembly before being actuated.
Figure 10:
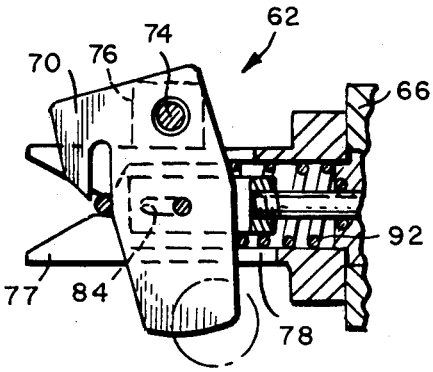
FIG. 10 is a fragmentary section of the gripper assembly showing an intermediate position after having been actuated.
Figure 11:
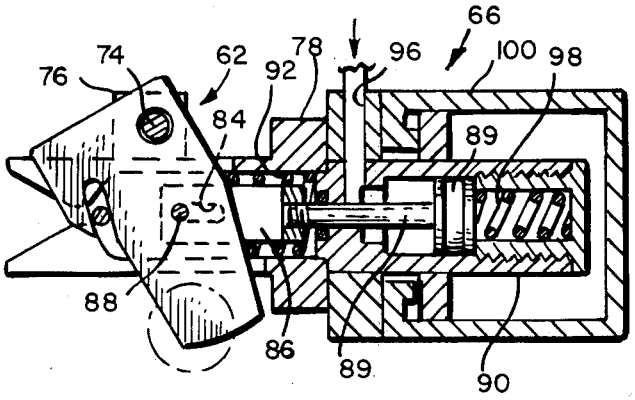
FIG. 11 is a fragmentary elevation showing the gripper assembly in gripping position.

The combination separating, orienting and transfer means 20 is located at the forward end of the conveyor in the direction of movement and is provided with a gripper assembly 62 for taking hold of the lead coil intermediate its lower and upper ends and moving it onto a turntable 64 for rotation about its vertical axis through an angle of approximately 120°. The gripper assembly 62 is mounted on a carriage 66, FIGS. 3 and 4, movable longitudinally in reciprocation from the discharge end of the conveyor to a position adjacent the turntable 64. The gripper assembly 62 as shown in FIGS. 9, 10 and 11 comprises a flat plate 70 containing an inclined slot 72 pivotally mounted for movement in a vertical plane between the opposite sides 77—77 of a slotted block 78 mounted on the carriage. A pin 74 fixed at its ends in bosses 76—76 on the block pivotally support the plate 70. The sides 77—77 of the block have at their ends V-shaped openings 80—80 for receiving a turn of the coil at the delivery end of the conveyor. The plate 70 contains a slot 84 and is pivotally connected to a slotted coupling 86 by means of a pin 88. The coupling is threaded onto a piston rod 89 confined within a cylinder 90 mounted on the carriage assembly. Reciprocation of the piston and rod will swing the plate 70 about the pin 74 from the position shown in FIG. 10 to the position of FIG. 11 to engage the slot 72 with a turn of the coil to thereby captivate the coil. At the rear side of the slot 72 there is a nose which is moved downwardly as the leading coil is pushed against the edge of the plate to prevent acceptance of more than one turn of wire into the V-shaped opening and to enter between the leading coil and the succeeding coil to stop the latter. The plate 70 is held in its inoperative position by the provision of two coiled springs, a coil spring 92 supported within an opening 94 in the block with one end engaged with the forward edge of the plate 70 and a coil spring 98 disposed in the cylinder forwardly of the piston. In order to swing the plate 70 downwardly to captivate the coil air pressure is supplied to the rear side of the piston through a passage 96. The length of the slot 72 in the plate 70 is such that in its captured position the coil can be rotated about its vertical axis.

The plate 70 and its operating mechanism are supported on a horizontally disposed hollow rigid bar 100 which extends transversely of the apparatus and which in turn is supported by the carriage 66 for movement longitudinally in reciprocation between the delivery end of the conveyor and the turntable 64 and also for rotation about its longitudinal axis from a position in which the plate 70 is adjacent the turntable 64 to a position in which it is adjacent the assembly machine 16.

The carriage 66 comprises two T-shaped trolleys 102—102, the heads 104—104 of which are provided with rollers 106—106 engaged within horizontally disposed tracks 108—108 suspended from the upper transverse beams 26—26. The legs 110—110 of the trolleys have adjustably mounted thereon supports 112—112 each of which comprises spaced parallel plates 114—114, bolted together, so as to slidably receive the leg of the trolley. A bracket 116 is fixed to the leg and a second bracket 118 to the support 112 parallel to the bracket 116. These brackets contain vertically aligned openings 120 and 122 for receiving an adjusting bolt 124 by means of which the heightwise position of the support 112 on the trolley may be adjusted. The bar 100 has at its opposite ends gudgeons 126—126 which are rotatably received in bearing blocks 128—128 bolted to the supports 112—112.

The carriage comprising the trolley members 102—102 and the bar 100 is moved in reciprocation by an air cylinder 130 containing a piston 132 to which is connected one end of a rod 134. The opposite end of the rod is connected to one of the trolleys 114. By supplying air to the ends of the cylinder 130 at appropriate times as will be described hereinafter, the carriage may be moved in reciprocation from the discharge end of the conveyor to the turntable and back.

Figure 15:
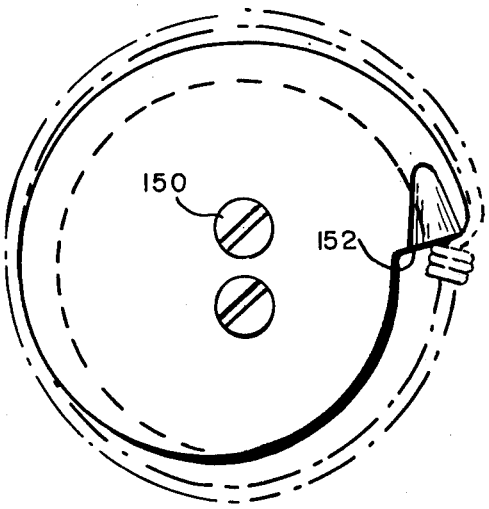
FIG. 15 is a plan view of the turntable.
Figure 14:
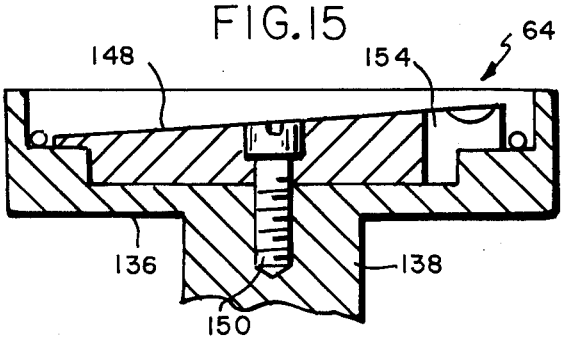
FIG. 14 is a fragmentary section to larger scale taken diametrically through the turntable.

As the carriage moves toward the turntable the lower end of the coil spring is moved upwardly by the upwardly inclined surface 67 of a ramp 68 so as to place the lower portion of the spring under compression and hence to cause it to have firm engagement with the turntable as it is moved onto the turntable. As illustrated in FIGS. 14 and 15, the turntable 64 comprises a cup-shaped member 136 at the upper end of a vertical shaft 138, the latter being rotatably supported, FIGS. 3 and 4, in a vertically disposed opening 140 in the subassembly frame 28. Rotation of the post 138 and hence of the turntable is effected by means of an arm 142 clamped to the lower end of the post 138 which has at its distal end a roller 144 engaged with a slot 146 in a block 147. A shaft 146 extending transversely of the frame and reciprocated by an air cylinder 151 provides for oscillating the arm 142 and hence rotation of the turntable.

Figure 12:
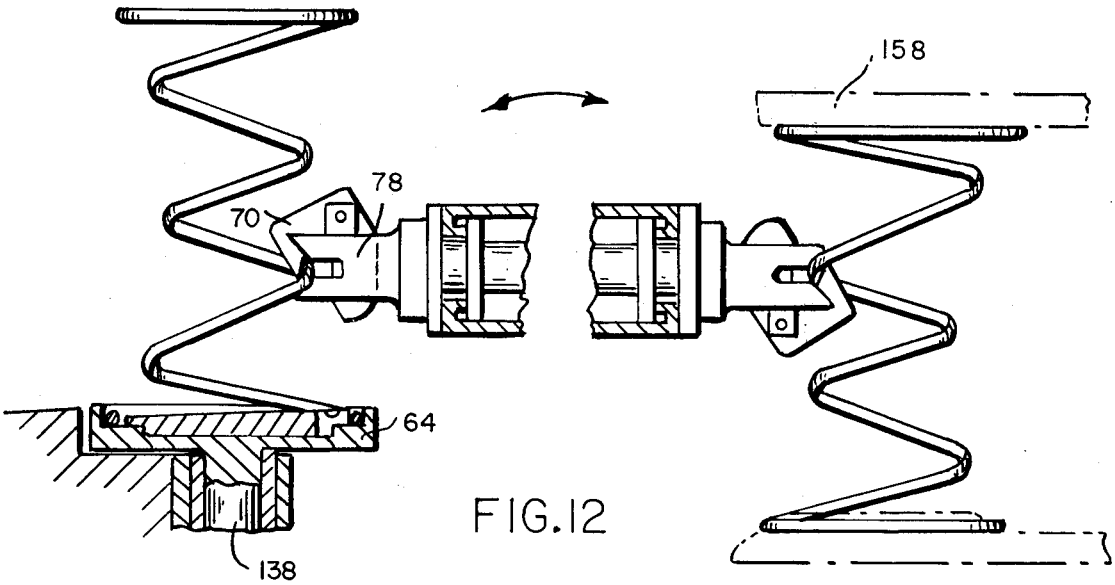
FIG. 12 is a fragmentary elevation showing rotation of the gripper assembly on the carriage from the turntable to the assembly machine.
Figure 13:
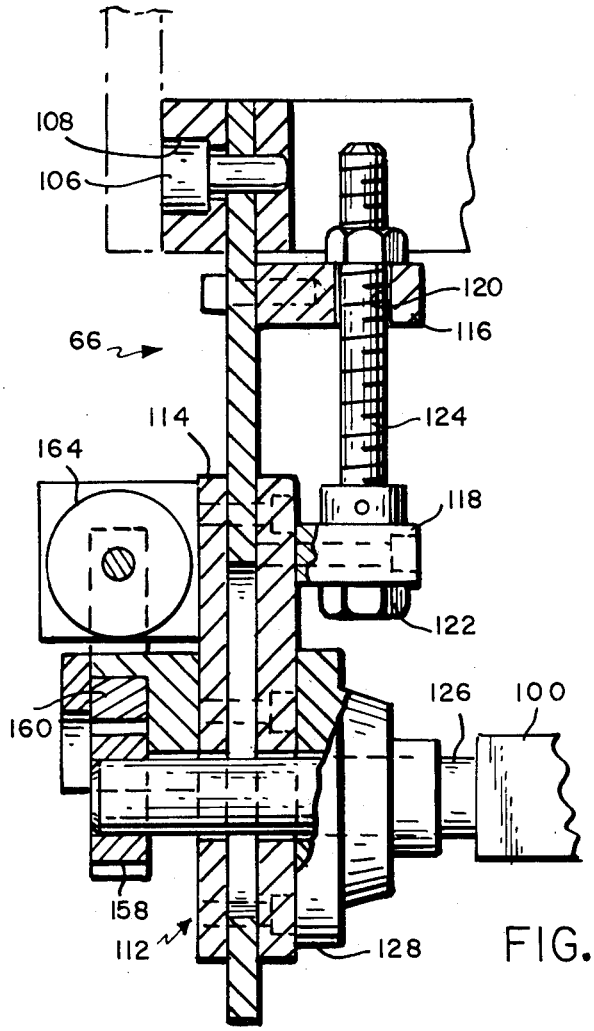
FIG. 13 is a section taken on the line 13—13 of FIG. 4.

The cup-shaped member 136 contains a notched disk 148 of a dimater such that it will fit within the end loop at the lower end of the coil and is fastened in the cup by means of screw bolts 150—150. The notch 152 in the disk provides a vertical surface 154 which by engagement with the knot at the lower end of the coil will cause the coil to be rotated with the turntable as the latter is rotated. The vertical compression of the spring as it moves up the ramp insures seating of the lower open end of the coil over the disk 148. The coil is rotated by the turntable through approximately 120° as will be described hereinafter whereupon the bar 100 is rotated about its horizontal axis to move the plate 70 and its operating mechanism from its position above the turntable to the position adjacent the spring assembly machine 16 as shown in FIGS. 4 and 12. Rotation of the bar 100 is provided for by a gear 158, FIG. 13, fastened to the gudgeon 126 at one end of the bar 100 which meshes with a rack bar 160. The rack bar is affixed at its opposite ends in parallel relation to the opposite ends of a piston rod 162, FIGS. 3 and 4, reciprocation of which is provided for by a cylinder 164 mounted on the support 112. The stroke of the rod 162 is such as to rotate the bar 100 through an angle of 180°. Rotation of the bar 100 moves the plate 70 and its operating mechanism from the turntable to the assembly machine 16, inverting the coil end-for-end as it does so and depositing it with its lower end over a circular plate 156 at the entrance to the assembly machine. Reciprocably movable members 158—158 comprising a part of the assembly machine move rearwardly over the upper and lower ends of the coil into engagement with the ends and as they clamp the ends of the coil effect release of the coil from the plate 70, rotation of the gripper assembly rearwardly through 180° and movement of the carriage rearwardly to the conveyor so as to be in a position to receive the succeeding coil.

In operation of the apparatus a batch of coils placed on the receiving end of a conveyor 18 is moved forwardly and as it is moved forwardly the individual coils are partially separated. When the leading coil reaches the discharge end of the conveyor it is grasped or captured by the plate 70 and pulled free of the succeeding coils, the latter being restrained by a spring finger 160 disposed to engage the second of the coils in the batch of coils, moved forwardly up the ramp 68 onto the turntable 64, rotated by the turntable about its vertical axis through approximately 120°, rotated about the horizontal axis of the bar 100 through 180° to invert it and deposit it at the entrance to the assembly machine 16. There are, as related heretofore, a number of conveyors and combination separating, orienting and transfer means corresponding to the number of coils to be formed into a spring assembly so that during each cycle of operation a transverse line of coils are advanced to the assembly machine. As each coil is deposited it produces a signal and there is means which prevents release of any coil at the assembly machine until all of them are in place and ready for release.

Figure 16:
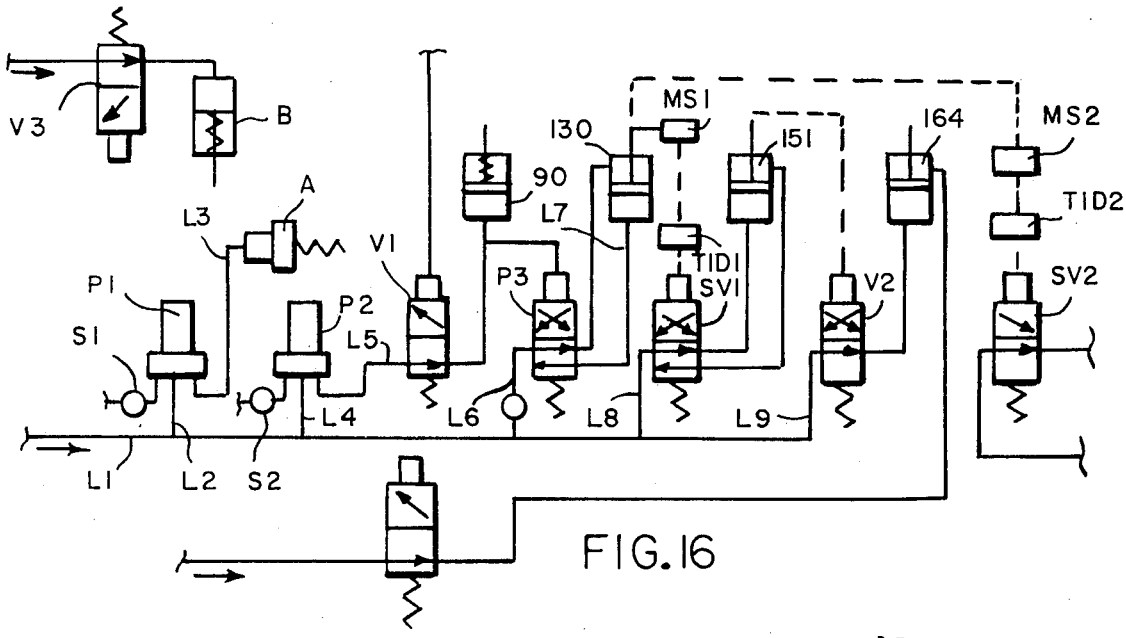
FIG. 16 is a diagram of the control system.

The conveyors are driven by the motor M and the operation of the gripper plate, the reciprocal movement of the carriage, rotation of the turntable and rotation of the gripper plate assembly to invert the coil are all effected by means of air cylinders which will now be described with particular reference to FIGS. 1, 2 and 16. The motor M drives the conveyors through the air clutches A and there is provided at the forward end of each conveyor a sensor S1 located at the discharge end of the conveyor so as to be engaged by the coil at this position. Displacement of the sensor supplies air at approximately 80 lbs. p.s.i. from a supply line L1 through a line L2, pressure operated pilot P1, and line L3 to the air operated clutch A to disengage the drive and hence to stop the conveyor. As the coil enters the V-shaped opening of the gripper assembly it rotates the plate downwardly on its pivot into engagement with a sensor S2 which supplies 80 lbs. pressure from the line L1 through a line L4, pressure operated switch P2 and line L5 to the air cylinder 90 to cause the plate 70 to close on the coil. Simultaneously, the cylinder 130 is supplied with air from the line L1 through a line L6, pilot P3 and line L7 to move the carriage forwardly to position the coil on the turntable. If the next coil in line at this time has not reached the end of the conveyor sensor S1 will re-engage the air clutch A so that the conveyor will start up and advance the next coil to the position of gripping. There is a mechanical valve V1 in the line L5 which in its open position holds the coil receiving arms of the assembly machine retracted. At the end of the stroke of the cylinder 130, cylinder 151 is supplied with pressure from the line L1 through line L8 and solenoid operated valve SV1 to turn the turntable through 120°. A micro switch Ms1 actuated by means of the carriage at its forward position energizes the solenoid switch SV1. A time delay TD1 is provided in the line to the solenoid valve SV1. After the turntable has turned the coil 120°, cylinder 164 is supplied with pressure from the line L1 through line L9 and mechanical valve V2 to rotate the bar 100 and hence the gripper assembly through 180° to invert the coil and present it to the assembler. The carriage at the place of inversion of the coil actuates a micro switch MS2 which through a time delay TD2 conditions the solenoid valve SV2 for operation. The solenoid valves SV2 of the several mechanisms transversely of the apparatus are wired in series so that until the several circuits are completed, indicating that there is a complete line of coils on the assembly machine, operation of the assembly machine will not be initiated. When the series circuit is completed the assembly machine will be started, and pressure will be supplied through a valve V3 in the assembly machine to an air cylinder B to close the coil receiving arms 158 to grip the coils. When the arms grip the coils the cylinders 90 are de-energized to release the coils from the gripper plates and simultaneously the cylinders 130 are energized to return the carriages to their pick-off positions. As the carriages return the cylinders 151 and 164 are energized to return the bar 100 and turntables 64 to their original positions.

It should be understood that the present disclosure is for the purpose of illustration only and includes all modifications or improvements which fall within the scope of the appended claims.

I claim:

1. Coil separating, orienting and transferring apparatus for separating coil springs from groups of coil springs, orienting the coils and presenting them to a spring assembly machine, properly positioning for lacing adjacent similarly positioned coils, comprising a conveyor for receiving a batch of coils standing on end, and moving the batch of coils along a predetermined path, gripping means at the delivery end of the conveyor for taking hold of the leading coil exclusively of the remaining coils in the batch and separating it from the remaining coils, a turntable upon which the separated coil is adapted to be placed standing upright for rotation about its vertical axis to effect orientation of the knot and a carriage supporting the gripping means for movement of the separated coil onto the turntable for such rotation, said gripping means being rotatable on the carriage following rotation of the coil about its vertical axis to remove the separated, oriented coil from the turntable and transport it to the assembly machine in an inverted position and said gripping means being further operable to release the coil in said inverted position.

2. Apparatus according to claim 1, including means situated along the conveyor operable by engagement with the coils in the groups of coils to progressively spread the coils as they are advanced to the discharge end of the conveyor.

3. Apparatus according to claim 1, including friction engendering means arranged along the path of movement of the conveyor operable on the coils of the groups of coils for progressively separating the coils.

4. Apparatus according to claim 1, including friction engendering and orienting means arranged along the path of movement of the conveyor operable by engagement with the upper and lower ends of the coils of the groups of coils to progressively partially separate them and orient them as they approach the delivery end of the conveyor.

5. Apparatus according to claim 1, wherein there is means at the delivery end of the conveyor supported above the lower end loop of the leading coil in a position to intercept the lower end loop of the succeeding coil, operable to hold back the succeeding coil while the leading coil is being moved forwardly by the gripping means.

6. Apparatus according to claim 5, wherein said means is a flexible spring finger supported with its distal end spaced above the plane of the conveyor.

7. Apparatus according to claim 1, comprising means on the conveyor operable by engagement with the lower end loops of the coils to advance the coils and stationary friction engendering means with which the ends of the coils are slidingly engaged as they are moved forwardly by the conveyor operable to separate the coils.

8. Apparatus according to claim 7, wherein the means on the conveyor are lugs and the stationary means are members parallel to the conveyor having edges which converge in the direction of movement of the conveyor, said lugs urging the coils forwardly against the resistance to forward movement of said converging edges.

9. A coil transfer for delivering coil springs at a predetermined rate and in predetermined positions of orientation to a spring assembly machine, comprising a conveyor having a horizontal run on which there are longitudinally spaced lugs, a gripping means movable to a predetermined position adjacent the delivery end of the conveyor to take hold of the leading coil, sensing means at the delivery end of the conveyor responsive to the presence of the leading coil in a position to be taken by the gripping means to cause the gripping means to take hold of the leading coil, a turntable upon which the separated coil is adapted to be placed standing upright for rotation by its vertical axis, a carriage supporting the gripping means for movement from the delivery end of the conveyor to the turntable to position the coil on the turntable, movement of the carriage being initiated by the gripping of a coil in the gripping means as the latter moves the coil onto the turntable for effecting rotation of the turntable to turn the coil about its vertical axis while within the grip of the gripping means and means operable by the turntable when it has turned the coil a predetermined distance for effecting rotation of the gripping means on the carriage to transport the coil from the turntable a predetermined distance to a position of reception by the assembly machine, inverted, and release the grip of the gripping means on the coil.

10. Apparatus according to claim 9, wherein the sensing means is operable in the absence of a coil at the delivery end of the conveyor in a position to be taken by the gripping means to start the conveyor.

11. Apparatus according to claim 1, wherein there is means arranged in the path of movement of the batch of coils at a level above the lowermost loop of the leading coil in a position to intercept the lowermost loop of the succeeding coil, said means being operable to yieldably resist displacement of the succeeding coil from the batch of coils during separation of the leading coil therefrom.

12. Apparatus according to claim 1, wherein the turntable is elevated with respect to the plane of the conveyor and there is means for compressing the portion of the coil below the gripped portion thereof to guide the lower end upwardly onto the turntable so that the coil is compressively held engaged with the turntable.

13. Apparatus according to claim 1, comprising means on the turntable engageable with the lower end loop of the coil for imparting the rotation of the turntable to the coil.

14. Apparatus according to claim 1, wherein there is means associated with the conveyor for rotating the coils about their vertical axis as they travel toward the discharge end of the conveyor to a position in which the knots at the lower ends of the coils are all disposed to travel along a predetermined path parallel to the direction of movement of the conveyor.

15. Apparatus according to claim 14, wherein said means comprises cam guides at the upper and lower ends of the coils for rotating the coils about their vertical axis to dispose all of the coils in substantially the same position of orientation.

16. Apparatus according to claim 14, wherein there is means on the turntable engageable with the knot on the lower end loop of a coil for imparting the rotation of the turntable to the coil.

17. Apparatus according to claim 16, wherein said means is displaced laterally relative to the path of movement of the knots in a direction opposite to the direction of rotation of the coils so as to become engaged with the knots by rotation of the turntable.

18. Apparatus according to claim 1, wherein there are guide rails at the upper and lower ends of the coils which extend along the conveyor for slidingly receiving the lower side of the end loop at the top and the upper side of the end loop at the bottom, said guide rails having edges inclined toward the centerline of the conveyor for engagement with the knots in the end loops to effect rotation of the coils to dispose the knots substantially in line with respect to the path of movement of the coils.

19. Apparatus according to claim 18, wherein the guide rail at the top is at one side of the conveyor and the guide rail at the bottom is at the other side.

20. Coil separating, orienting and transferring apparatus for separating coil springs from groups of coil springs, orienting the spring and presenting them to a spring assembly machine properly positioned for lacing adjacent similarly positioned coils, comprising a conveyor for receiving a batch of coils standing on end and moving them along a predetermined path oriented with respect to their vertical axes with the knots aligned in the same direction, means operable in conjunction with the conveyor as the coils are moved along to effect a partial separation of the coils of the group from each other, gripping means comprising a slotted plate rotatable about a horizontal axis transverse to the conveyor to engage a convolution of the leading coil of the troup intermediate its ends within the slot, means operable when the leading coil is at the delivery end of the conveyor and the slotted plate is at said end in a coil receiving position to effect rotation of the slotted plate to engage a convolution of the coil therewith, a turntable upon which the separated coil is adapted to be placed, a carriage supporting the gripping means for movement from the delivery end of the conveyor to a position to deposit the coil on the turntable, said last means operating to initiate movement of the carriage to deposit the coil on the turntable, means operable at this position of the carriage to effect rotation of the turntable, means operable by rotation of the turntable to effect rotation of the gripping means on the carriage to move the coil from the turntable to a predetermined position of acceptance of the coil by the assembly machine and means operable at said place of acceptance to release the grip of the slotted plate on the coil and return the carriage to its initial position.

21. Apparatus according to claim 20, wherein the slot in the slotted plate is designed to apply a pulling force on the coil in the direction of the path of movement of the coil while permitting free rotation of the coil about its vertical axis in the course of such movement.

22. Coil separating, orienting and transferring apparatus for separating coil springs from groups of coil springs, orienting the springs and presenting them to a spring assembly machine, comprising in line a conveyor, a gripping means assembly, a carriage mounting the gripping assembly and a turntable, said conveyor having a horizontal run and receiving and delivery ends for advancing groups of coils placed thereon to said gripper assembly, said gripper assembly comprising a slotted plate rotatable about an axis transverse to the conveyor to engage a convolution of the coil in the slot intermediate the ends of the coil, said carriage being movable to in turn move the gripper assembly with the coil gripped thereby to a position on the turntable for rotation about its vertical axis and said assembly being rotatable on the carriage following rotation of the coil about its vertical axis to invert the coil end for end and release it from the grip of the gripper.

23. Apparatus according to claim 22, comprising a control circuit for effecting sequential operation of the several components of the apparatus during each cycle of operation.

24. Apparatus according to claim 22, wherein there are a plurality of coil transfer, separating, orienting and transfer apparatus arranged in parallel relation for delivering a transversely extending line of coils to a coil assembly machine.

25. Apparatus according to claim 24, wherein there is a switch at the plate of release of the coils for each apparatus operable by the presence of a coil at the place of release, said switches being circuited in series and means operable by completion of the series circuit of switches to produce a signal to effect release of the coils and return of the carriages to their initial positions.

26. Apparatus for supplying springs in predetermined positions of orientation to a spring assembly machine, comprising in line, a conveyor, a gripper assembly, a carriage mounting the gripper assembly and a turntable, said conveyor having a horizontal run, means including a clutch for driving the conveyor to move a group of coils placed at the receiving end to the delivery end, a jaw on the gripper assembly, said jaw being movable downwardly by engagement of the leading coil therewith to receive the leading coil and intercept the succeeding coil, sensing means at the delivery end of the conveyor responsive to the presence of a coil to effect disengagement of the clutch to stop the conveyor, means for effecting reciprocation of the carriage from a position in which the gripper assembly is adjacent the delivery end of the conveyor to a position in which the gripper assembly is adjacent the turntable, means operable by downward movement of the jaw to close the jaw on the coil and to initiate movement of the carriage, means operable by movement of the carriage to said position adjacent the turntable to effect rotation of the turntable approximately 120° and means operable by rotation of the turntable to effect rotation of the gripper assembly about a horizontal axis on the carriage to invert the coil.

27. Apparatus according to claim 26, wherein the means for driving the conveyor is an electric motor, and the means for disengaging the clutch, lowering the jaw, reciprocating the carriage, rotating the table and rotating the gripper assembly are air cylinders.

28. Apparatus according to claim 1, wherein the conveyor is drivably connected to a motor by a clutch and there is sensing means at the delivery end of the conveyor operable by the presence of a coil at the delivery end to effect disengagement of the clutch.

29. Apparatus according to claim 28, wherein the clutch is air operated and is supplied with air through a valve and operation of the sensing means closes the valve.

30. Apparatus according to claim 1, comprising second sensing means operable by the entrance of a coil into the gripping means at its place of adjacency to the delivery end of the conveyor to effect gripping of the coil.

31. Apparatus according to claim 30, wherein the gripping means embodies a pneumatically operated jaw and is connected by a valve to the source of pressure and wherein the second sensing means controls the supply of pressure to the valve.

32. Apparatus according to claim 2, wherein there is a second sensing means operable by the entrance of a coil into the gripper when the latter is at the place of adjacency to the delivery end of the conveyor to simultaneously cause the gripper to grip the coil and effect movement of the carriage from the delivery end of the conveyor towards the turntable.

33. Apparatus according to claim 32, wherein an air cylinder provides for effecting movement of the carriage and is connected to a source of air pressure by a valve and the second sensing means controls the supply of air pressure to the air cylinder.

34. Apparatus according to claim 2, wherein an air cylinder is connected to the gripper and an air cylinder is connected to the carriage, valves connect the air cylnders to a source of pressure and the second sensing means control the valves.

35. Apparatus according to claim 2, wherein the carriage travels forwardly and rearwardly a predetermined distance from the delivery end of the conveyor to the turntable and there is means operable by movement of the carriage beyond the turntable to cause the gripper to be rotated thereon.

36. Apparatus according to claim 1, wherein the carriage travels forwardly and rearwardly a predetermined distance from the delivery end of the conveyor to the turntable and back, an air cylinder connected to the turntable provides for effecting rotation thereof, said air cylinder being connected to a source of pressure by a valve and there is means operable by movement of the carriage to said forward position to actuate the valve.

37. Apparatus according to claim 36, wherein the valve is solenoid operated and wherein the means operable by the carriage is a micro switch.

38. Apparatus according to claim 37, wherein there is a time delay relay in the micro switch circuit.

39. Apparatus according to claim 1, wherein there is an air cylinder operable to rotate the gripper on the carriage, a valve connecting the air cylinder to a source of pressure and an element movable by the rotation of the turntable a predetermined distance to actuate the valve.

40. Apparatus according to claim 39, wherein the gripper is supported on a rotatable shaft mounted on the carriage and rotation of the shaft is effected by a pinion on the shaft, a rack in mesh therewith and means connecting the rack to the air cylinder.

41. Apparatus according to claim 1, wherein there is means at said predetermined position of transfer of the coils to the assembly machine operable to initiate a cycle of operation of the assembly machine.

42. Apparatus according to claim 41, wherein there is one such means for each coil delivered to said place and said means are in series so that all of said means are required to be activated to initiate operation of the assembly machine.

43. Apparatus according to claim 42, wherein said assembly machine has jaws movable to said predetermined positions to take hold of the coils at said predetermined positions and there is means operable by engagement of the jaws with the coils to cause the grippers to release the coils, rotate them back to the turntable and move the carriage back to said predetermined position adjacent the delivery end of the conveyor.

* * * * *